United States Patent [19]

Wood et al.

[11] 4,318,476

[45] Mar. 9, 1982

[54] ARTICLE CARRIER

[75] Inventors: Prentice J. Wood, Hapeville; Richard K. Watkins, Lithonia, both of Ga.

[73] Assignee: The Mead Corporation, Dayton, Ohio

[21] Appl. No.: 162,620

[22] Filed: Jun. 24, 1980

[51] Int. Cl.[3] ..... B65D 75/58; B66C 1/10; B65D 75/00; B65D 71/00

[52] U.S. Cl. ..... 206/459; 206/153; 206/158; 294/87.2

[58] Field of Search ..... 206/153, 158, 427, 216, 206/459; 294/87.2

[56] References Cited

U.S. PATENT DOCUMENTS 3,170,570 2/1965 Rice ..... 206/153
3,528,697 9/1970 Wood ..... 294/87.2
3,860,281 1/1975 Wood ..... 206/158
4,180,191 12/1979 Wood ..... 294/87.2

*Primary Examiner*—William T. Dixson, Jr.
*Attorney, Agent, or Firm*—Rodgers & Rodgers

[57] ABSTRACT

An article carrier comprising bottom panel elements, inner and outer side wall means upstanding from the bottom panel elements, apertures formed in the side wall means for receiving the neck portions of the packaged articles, the bottom panel elements arranged to define bottom apertures, the bottom apertures aligned respectively with the apertures, pull tabs formed in one of the outer side walls and extending between each pair of aligned apertures, cut lines disposed in the inner side wall adjacent the pull tab, and an ad panel foldably joined to the other outer side wall and extending downwardly therefrom.

12 Claims, 6 Drawing Figures

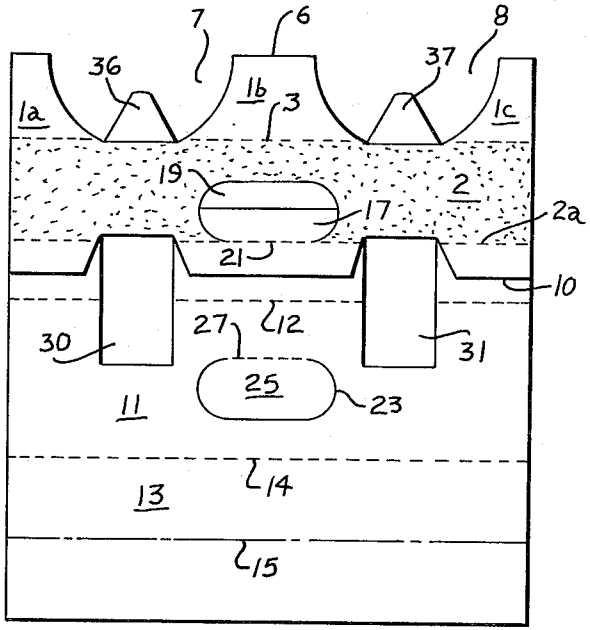
Fig. 4
Fig. 3
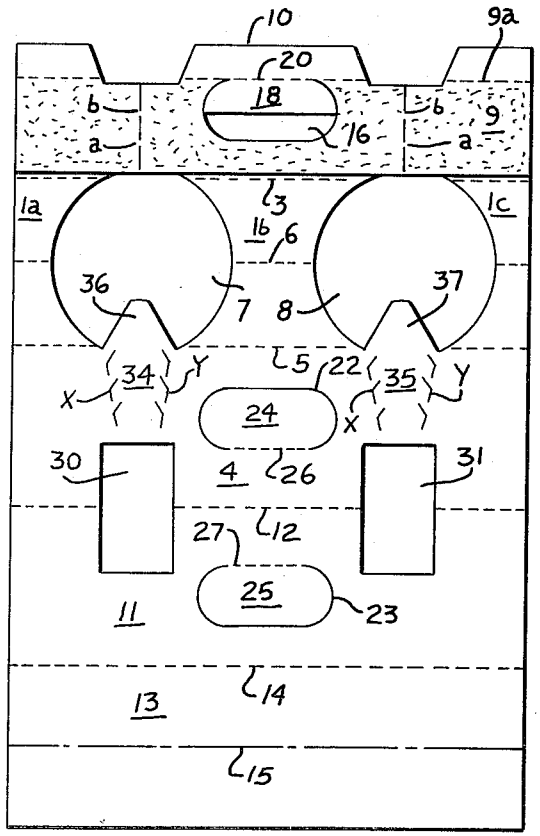

ARTICLE CARRIER

TECHNICAL FIELD

This invention relates to top gripping type article carriers which are economical to manufacture, easy to open, and have an increased promotional capability.

BACKGROUND ART

In general article carriers of the top gripping variety are known in the art as evidenced by U.S. Pat. Nos. 3,528,697; 3,640,563; 3,860,281; and 4,180,191, all of which are owned by the assignee of this invention.

DISCLOSURE OF INVENTION

According to this invention, an article carrier is provided and comprises bottom panel elements arranged to define a bottom aperture, face contacting inner and outer side walls converging upwardly from each side of the bottom panel elements, a pair of apertures formed respectively in the inner and outer side walls, a pull tab extending between the bottom aperture and the aperture formed in the outer side walls, and a cut line formed in the corresponding inner side wall adjacent the pull tab and extending between the aperture formed in the inner side walls and the bottom aperture.

BRIEF DESCRIPTION OF DRAWINGS

In the drawings

FIGS. 3 and 4 depict intermediate stages through which the blank is manipulated and glued in order to form the complete and collapsed carrier shown in FIG. 5.

BEST MODE FOR CARRYING OUT THE INVENTION

Figure 2:
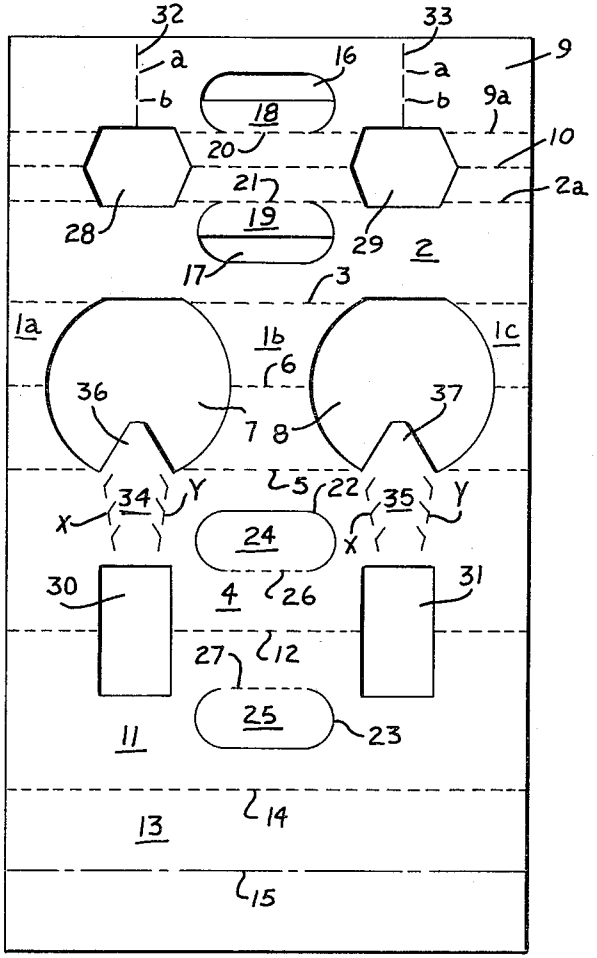
FIG. 2 is a plan view of the blank from which the carrier shown in FIG. 1 is formed.

In the drawings the numerals 1*a*, 1*b*, and 1*c* depict the bottom panel elements of the carrier to one of the side edges of which inner side wall 2 is foldably joined along interrupted fold line 3. In like manner outer side wall 4 is foldably joined to bottom panel elements 1*a*, 1*b*, and 1*c* along interrupted fold line 5. In addition bottom panel elements 1*a*, 1*b*, and 1*c* are provided with interrupted medial fold line 6. For the purpose of receiving portions of the articles to be packaged, apertures 7 and 8 are provided and are defined by bottom panel elements 1*a*, 1*b*, and 1*c*.

To complete the basic elements of the blank, inner side wall 9 is foldably joined to inner side wall 2 along medial fold line 10. Inner side walls 2 and 9 are provided with interrupted bend lines 2*a* and 9*a*. Also outer side wall 11 is foldably joined to outer side wall 4 along medial fold line 12. According to a feature of this invention ad panel 13 is foldably joined to outer side wall 11 along fold line 14 and is provided with cut score line 15 which is parallel to fold line 14.

For the purpose of transporting the carrier, hand gripping apertures 16 and 17 are formed in inner side walls 9 and 2 respectively. Additionally, hand cushioning flaps 18 and 19 are foldably joined to inner side walls 9 and 2 along fold lines 20 and 21 respectively. Also finger gripping apertures 22 and 23 are formed in outer side walls 4 and 11 respectively and are provided with hand cushioning flaps 24 and 25 which are foldably joined to outer side walls 4 and 11 along fold lines 26 and 27 respectively.

For the purpose of receiving and retaining the upper neck portions of the packaged articles, carrier apertures are provided. More specifically apertures 28 and 29 are formed in inner side walls 2 and 9 and are disposed astride medial fold line 10. In like manner apertures 30 and 31 are formed in outer side walls 4 and 11 and are disposed astride medial fold line 12.

According to a feature of this invention, cut lines 32 and 33 are formed in inner side wall 9 and extend respectively from the upper edges of apertures 28 and 29, as viewed in FIG. 2, upwardly to the free edge of inner side wall 9. In addition each cut line 32 and 33 is provided with frangible nicks a and b. Essentially nicks a and b constitute small paperboard connections between adjacent portions of the blank and simply serve the purpose of holding the portions of the blank along each cut line 32 and 33 in the proper relative positions as the blank is manipulated and glued during the manufacturing process.

For the purpose of opening the carrier and gaining access to the packaged articles, pull tabs 34 and 35 are provided. In order to facilitate removal of the pull tabs during the carrier opening operation, each pull tab is provided with a pair of severance lines x and y. Additionally, thumb tabs 36 and 37 form the end portions of pull tabs 34 and 35 respectively and are in effect struck from apertures 7 and 8 respectively.

In order to form the carrier from the blank shown in FIG. 2, initially inner side wall 9 is elevated and folded over along medial fold line 10 to occupy the position shown in FIG. 3. Thereafter an application of glue is made to the exposed portion of inner side wall 9 disposed between interrupted bend line 9*a* and the lower edge thereof as shown by stippling in FIG. 3. Thereafter the elements of the blank disposed above medial fold line 6 are elevated and folded over to occupy the positions shown in FIG. 4 and inner side wall 9 is adhered to outer side wall 4. Then an application of glue is made to the exposed portion of inner side wall 2 between interrupted bend line 2*a* and fold line 3 as shown by stippling in FIG. 4. Following this operation the elements of a blank disposed above medial fold line 12 are elevated and folded over into the positions shown in FIG. 5. By this operation inner side wall 2 is adhered to outer side wall 11. The carrier as shown in FIG. 5 is in its completed and collapsed condition.

Figure 1:
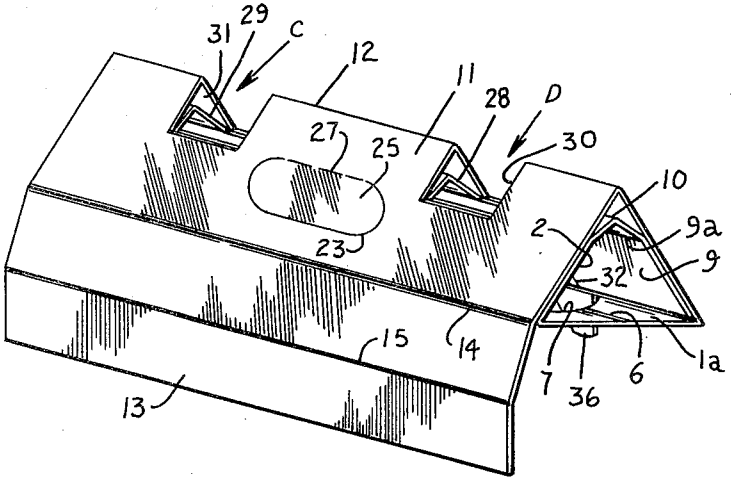
FIG. 1 is an isometric view of an article carrier formed according to this invention.
Figure 5:
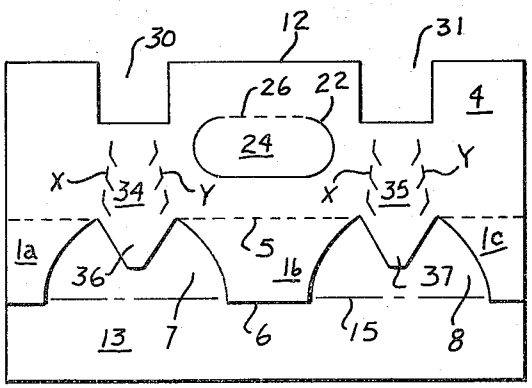

In order to set up the carrier from the condition shown in FIG. 5, it is simply necessary to fold bottom panel elements 1*a*, 1*b*, and 1*c* into a flat plane. As this occurs the pair of side walls of the carrier are automatically moved apart. Then it is simply necessary to lower the carrier onto the articles to be packaged whereby the flanged neck portion of each article is maneuvered into an interlocked relationship with the lower edge of the respective upper carrier apertures identified in the drawing generally by the letters C and D. The carrier then appears as shown in FIG. 1.

Figure 6:
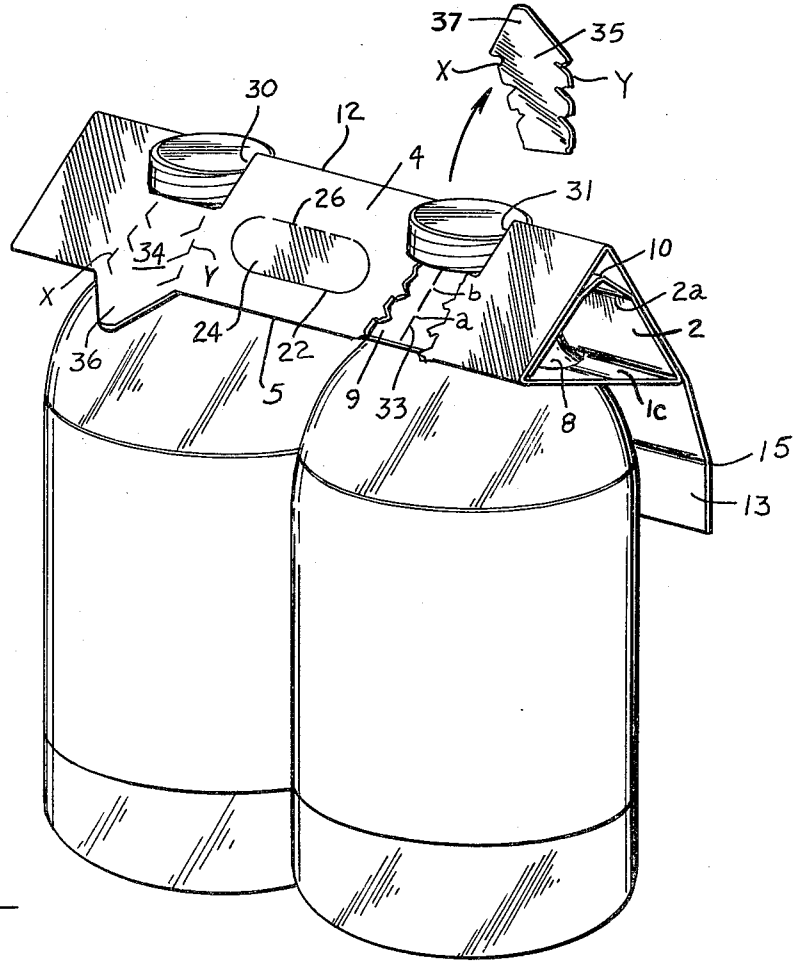
FIG. 6 is a perspective view of an erected carrier with one of the pull tabs torn away.

In order to open the carrier and thereby release the articles contained therein, it is simply necessary to grasp thumb tabs 36 or 37 and pull upwardly. By this operation the respective pull tab 34 and 35 is torn along severance lines X and Y thereby exposing cut lines 32 and 33 respectively as shown in FIG. 6. Then the article is simply removed from the carrier since nicks a and b are easily broken and offer no resistance to the removal of the article. Therefore by this invention the carrier pull tab is operable even though it is positioned on the outer side wall of a double side wall constructed carrier. This allows portions of the pull tabs to be struck from the apertures formed in the bottom wall such as elements 7 and 8. Otherwise portions of the pull tabs would be formed on the extreme end of the blank which would require a considerably larger amount of carrier material.

According to another feature of this invention, ad panel 13 is foldably joined to the lower edge of outer side wall 11. This feature allows for greater promotional flexibility than is usually found in the traditional top gripping type carrier. In addition cut score line 15 allows ad panel 13 to conform to the shoulder configuration of the packaged articles and in turn allows the lower portion thereof to lie in flat face contacting relation with the inner surface of a case when carriers are packaged in multiples of two or more. Also ad panel 13 provides cushioning between fragile articles such as bottles when the carriers are packed in a multiple carrier configuration.

INDUSTRIAL APPLICABILITY

By this invention, a conventional top gripping type article carrier is provided with a convenient opening means without the expenditure of an unnecessarily large amount of carrier material and at the same time provides additional carrier promotional means.

We claim:

1. An article carrier comprising bottom panel elements arranged to define a bottom aperture, a pair of inwardly sloping inner side walls upstanding respectively from opposite side edges of said bottom panel elements and foldably joined together along a first medial fold line at their upper edges one of which is foldably joined to side edges of said bottom panel elements on one side of the carrier, a pair of inwardly sloping outer side walls at least portions of which are disposed in flat face contacting relation respectively with said inner side walls and upstanding respectively from opposite side edges of said bottom panel elements one of which is foldably joined to side edges of said bottom panel elements on the opposite side of the carrier, a first aperture formed in said inner side walls and disposed astride said first medial fold line and in vertical alignment with said bottom aperture, a second aperture formed in said outer side walls and disposed astride said second medial fold line and in vertical alignment with said first aperture, a pull tab formed in one of said outer side walls and extending between said bottom aperture and said second aperture, and a cut line formed in one of said inner side walls which is in fact contacting relation with said one outer side wall and extending from said one aperture to said bottom aperture.

2. An article carrier according to claim 1 wherein at least one nick interconnects portions of the carrier disposed on either side of said cut line.

3. An article carrier according to claim 1 wherein said pull tab extends below said bottom panel elements.

4. An article carrier according to claim 1 wherein an ad panel is joined to the lower edge of the other of said outer side walls.

5. An article carrier according to claim 4 wherein a cut score line is disposed in said ad panel.

6. An article carrier according to claim 5 wherein said cut score line extends between the ends of said ad panel and is disposed generally parallel with the bottom edge of said other outer side wall.

7. An article carrier according to claim 1 wherein hand carrying means is disposed in said side walls.

8. An article carrier blank comprising a pair of inner side walls foldably joined together along a first medial fold line, a first bottle neck receiving aperture formed in said inner side walls and disposed astride said first medial fold line, bottom panel elements foldably joined along one side edge thereof to an edge of one of said inner side walls remote from the other of said inner side walls and defining a bottom aperture, a first outer side wall foldably joined to edges of said bottom panel elements remote from said inner side walls, a second outer side wall foldably joined to said first outer side wall along a second medial fold line remote from said bottom panel elements, a second bottle neck receiving aperture formed in said outer side walls and disposed astride said second medial fold line, a pull tab defined by a pair of severance lines and extending from said second bottle neck receiving aperture to said bottom aperture, and a cut line extending from said first bottle neck receiving aperture and transversely across one of said inner side walls to the end edge of the blank.

9. A blank according to claim 8 wherein an end of said pull tab extends between adjacent bottom panel elements and into said bottom aperture.

10. A blank according to claim 8 wherein at least one frangible nick is disposed astride said cut line.

11. A blank according to claim 8 wherein an ad panel is foldably joined to an edge of said second outer side wall along the edge thereof remote from said first outer side wall.

12. A blank according to claim 11 wherein a cut score line is formed in said ad panel and generally parallel to said edge of said second outer side wall.

* * * * *